US006743156B1

(12) United States Patent
Jacques, II et al.

(10) Patent No.: US 6,743,156 B1
(45) Date of Patent: Jun. 1, 2004

(54) WALKER APPARATUS

(75) Inventors: William L. Jacques, II, Batesville, IN (US); Michael Cerimele, Cincinnati, OH (US); Ken Meyer, Batesville, IN (US); John Sagel, Cincinnati, OH (US); Kenneth L. Kramer, Greensburg, IN (US); John P. Biondo, Aurora, IN (US); Gregory W. Branson, Batesville, IN (US); John W. Koenig, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/569,942

(22) Filed: May 12, 2000

Related U.S. Application Data

(60) Provisional application No. 60/133,751, filed on May 12, 1999.

(51) Int. Cl.[7] ..... A47D 13/04

(52) U.S. Cl. ..... 482/68; 482/66; 482/67; 135/65

(58) Field of Search ..... 482/66–68; 135/65–67, 135/74, 76

(56) References Cited

U.S. PATENT DOCUMENTS

| | | | | | |
|---|---|---|---|---|---|
| 4,345,790 | A | | 8/1982 | Coe | |
| 4,532,948 | A | | 8/1985 | Burrows | |
| D298,816 | S | | 12/1988 | Burkhart, deceased et al. | |
| 4,809,804 | A | | 3/1989 | Houston et al. | |
| 4,850,641 | A | | 7/1989 | Walker | |
| 4,858,125 | A | * | 8/1989 | Washizuka et al. | 135/65 |
| 4,907,794 | A | * | 3/1990 | Rose | 135/67 |
| 4,941,708 | A | | 7/1990 | Heffner | |
| 5,020,560 | A | * | 6/1991 | Turbeville | 135/67 |
| 5,040,556 | A | * | 8/1991 | Raines | 135/67 |
| 5,411,044 | A | * | 5/1995 | Andolfi | 135/66 |
| 5,476,432 | A | * | 12/1995 | Dickens | 482/67 |
| 5,511,571 | A | * | 4/1996 | Adrezin et al. | 135/66 |
| 5,704,577 | A | * | 1/1998 | Gordon | 135/66 |
| 5,862,825 | A | | 1/1999 | Leonard | |
| 5,882,067 | A | | 3/1999 | Carbajal et al. | |
| 5,891,021 | A | | 4/1999 | Dillon et al. | |
| 5,891,026 | A | | 4/1999 | Wang et al. | |
| 5,904,168 | A | | 5/1999 | Alulyan | |
| 6,070,603 | A | | 6/2000 | Politz | |

* cited by examiner

*Primary Examiner*—Glenn E. Richman
(74) *Attorney, Agent, or Firm*—Barnes & Thornburg

(57) ABSTRACT

A walker apparatus having a frame configured to support a user above a floor thereunder and an upper body support pivotably coupled to the frame to move between a use position and a storage position is shown. The upper body support is adapted to support the forearms of a user and includes a first pair of grip handles. A second pair of grip handles is coupled to the frame spaced apart from the first pair of grip handles. The walker apparatus has a patient measurement device coupled to the frame to measure a vital sign of the user and indicate the measurement on a display. An IV support is coupled to the frame to support a medical device. A base module is configured to hold personal belongings or medical devices. The frame includes upright segments extending from the base module. A seat has a frame member and a seat member. The frame member has a back segment and a seat segment coupled to the back segment. The seat member has a support wall, an oppositely facing wall, a front section coupled to the seat segment, and a rear section coupled to the uprights for movement about a pivot axis between a use position and a storage position. The back segment and the upright segments cooperate to limit pivotal movement of the seat when the seat is in the use position.

19 Claims, 4 Drawing Sheets

46
58
38
38
14
42
64
28
10
44
36
30
40
48
62
68
72
32
82
56
54
80
12
136
80
96
60
50
70
116
134
124
123
20
92
16
96
94
114
122
128
112
121
132
20
24
146
88
10
46
38
130
90
134
74
95
78
86
58
30
110
78
44
14
36
42
22
18
126
88
86
68
40
52
48
24
28
60
54
56
62
50
32
12
80
70
123
136
124
92
16

114
94
96
76
122
112
120
121
95
126
20
90
134
138
78
88
24
86
18
22

WALKER APPARATUS

The present application is based upon U.S. Provisional Application Ser. No. 60/133,751, filed on May 12, 1999 now abandoned, the complete disclosure of which is hereby expressly incorporated by reference.

BACKGROUND AND SUMMARY OF THE INVENTION

The present invention relates to a walker apparatus, more particularly the present invention relates to a walker apparatus including a frame, an upper body support, a seat, and a base module for accessories.

It will be appreciated that the prior art includes many types of walkers for assisting persons who have disabilities and need assistance in moving around. Typically, walkers are pushed along in front of the person, often a patient recovering from an illness or a person who is weak or unsteady. Such walkers have provided seats upon which the user may rest at times and other accessories such as attached IV stands. U.S. Pat. No. 5,704,577 issued Jan. 6, 1998; U.S. Pat. No. 4,532,948 issued Aug. 6, 1985; U.S. Pat. No. 4,941,708 issued Jul. 17, 1990; U.S. Pat. No. 4,345,790 issued Aug. 24, 1982; U.S. Pat. No. 5,882,067 issued Mar. 16, 1999; U.S. Pat. No. 4,850,641 issued Jul. 25, 1989; and U.S. design patent DES. 298,816 issued Dec. 6, 1988 are incorporated herein by reference to establish the nature and characteristics of walkers and their components. Also, U.S. Pat. No. 4,809,804 issued Mar. 7, 1989 is incorporated herein by reference to show a prior art combination wheelchair and walker apparatus.

The present invention is an improvement over prior art walker apparatus in several respects. While the present invention provides a walker with a seat supported on the walker for movement between a use position and a storage position, the walker also provides an upper body support portion which will support the upper body of the person using the walker when standing and leaning forwardly to rest. This upper body support portion is advantageous in that the person using the walker may rest his or her forearms on the upper body support portion while resting at intervals.

An embodiment of the present invention is a walker comprising a frame including a lower portion and an upper portion configured to be disposed in front of a person utilizing the walker for walking movement. The lower and upper portions have side portions and an intermediate portion between the frame lower and upper portions. Wheels movably support the frame lower portion. An upper body support portion is carried on the frame upper portion to be in front of the person's upper body to provide a support for the upper body when needed. In embodiments of the present invention, the upper body support portion includes an arm rest extending upwardly and forwardly to provide a forearm rest and a lower pair of grip handles extending downwardly and rearwardly to be gripped for walking support. An additional pair of upper grip handles are provided forwardly of the forearm rest to be gripped by the person when resting.

In embodiments of the present invention, the upper body support portion is pivotal on the frame upper portion between a use position with the lower pair of grip handles positioned for walking and a storage position in which the lower pair of grip handles are extending downwardly. It will be appreciated that when the walker is used for walking movement, the person using the walker will be standing and walking behind the frame and typically gripping the lower pair of grip handles for walking support. The walker will move on the wheels until a substantial portion of the person's weight is exerted on the grip handles to brake the wheels. At intervals, when the person needs rest, he or she may lean forwardly and place his or her forearms on the upper body support portion for rest while standing.

In accordance with embodiments of the present invention, when the persons needs further rest, a seat is provided having a patient support surface and a spaced apart oppositely facing lower surface. The seat is attached to the frame for movement between a first position in which the patient supporting surface is upwardly facing to facilitate sitting and a second storage position in which the lower surface faces the person utilizing the walker for walking movement.

The walker of the present invention comprises an upper body support portion extending upwardly and forwardly from the frame upper portion to support a person's forearms. In embodiments of the invention, this upper body support portion includes a portion extending inwardly, upwardly and forwardly from each side portion of the upper frame to provide a support for each forearm. A hand grip portion may be provided forwardly of this upper body support portion such that the person can lean forwardly for support and grip the hand grip portion for further support. This upper body support portion may also be provided with a handlebar extending rearwardly from each side portion of the frame upper portion to be gripped by the user when walking.

To provide stability and support, the present invention includes embodiments having a wheel support extending rearwardly from each side portion of the lower frame portion or from the lower base module of the walker. Each wheel support has a proximate end mounted to the lower frame portion and a distal end mounted to one of the wheels. Each such wheel support may be retractable or foldable to a storage position in accordance with the present invention.

In accordance with the present invention, various accessories are provided with the walker. Such a walker comprises a lower portion including a base module having a forwardly extending compartment for carrying such accessories. This base module has sides, a front and a rear section. Wheels movably support the base module. A frame extends upwardly from the rear section of the base module, and this frame has side portions and an upper portion extending between the side portions. The upper body support portion is carried on the frame upper portion to be in front of the upper body of a person utilizing the walker for walking movement. This upper body support is configured to provide support for the upper body when needed for rest. A seat is carried on the walker and attached for movement between a first position in which the seat is facing upwardly and a second position in which the seat is folded upwardly in a storage position.

In accordance with the present invention, various monitors and testers for physiological conditions of the user may be incorporated as described hereinafter. Displays for such monitors may be provided at convenient positions to be observed by the user. Additional accessories such as IV poles may be mounted on the walker for administering to the user.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2:
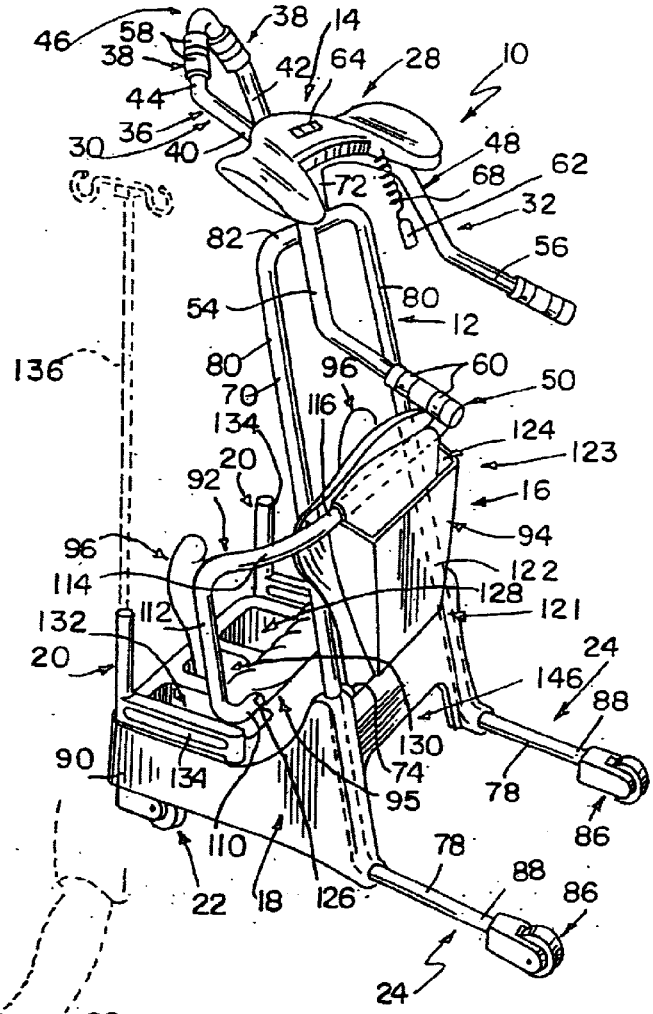
FIG. 1 is a perspective view of a walker apparatus showing the walker apparatus including a frame and an upper body support pivotably coupled to the frame, a seat in a storage position pivotably coupled to the frame, a base module coupled to the frame, a pair of IV supports pivotably coupled to the base module, a pair of front casters (one shown) coupled to the base module, and a pair of rear wheel units coupled to and extending away from the base module, the upper body support including an arm rest, an upper pair of grip handles coupled to the arm rest, and a lower pair of grip handles coupled to the arm rest, each pair of grip handles including a pair of measurement bands for detecting a patient's heart rate, the arm rest including a digital display electrically coupled to the measurement bands to indicate the measured heart rate, the walker apparatus further including a pulse oximeter coupled to the arm rest to measure the oxygen level in the patient's blood stream.
FIG. 2 is a side elevation view of the walker apparatus showing a user (in phantom) in a bent-over position leaning on the arm rest and gripping the upper pair of grip handles and the user (in phantom) in an upright position gripping the lower pair of grip handles.
Figure 4:
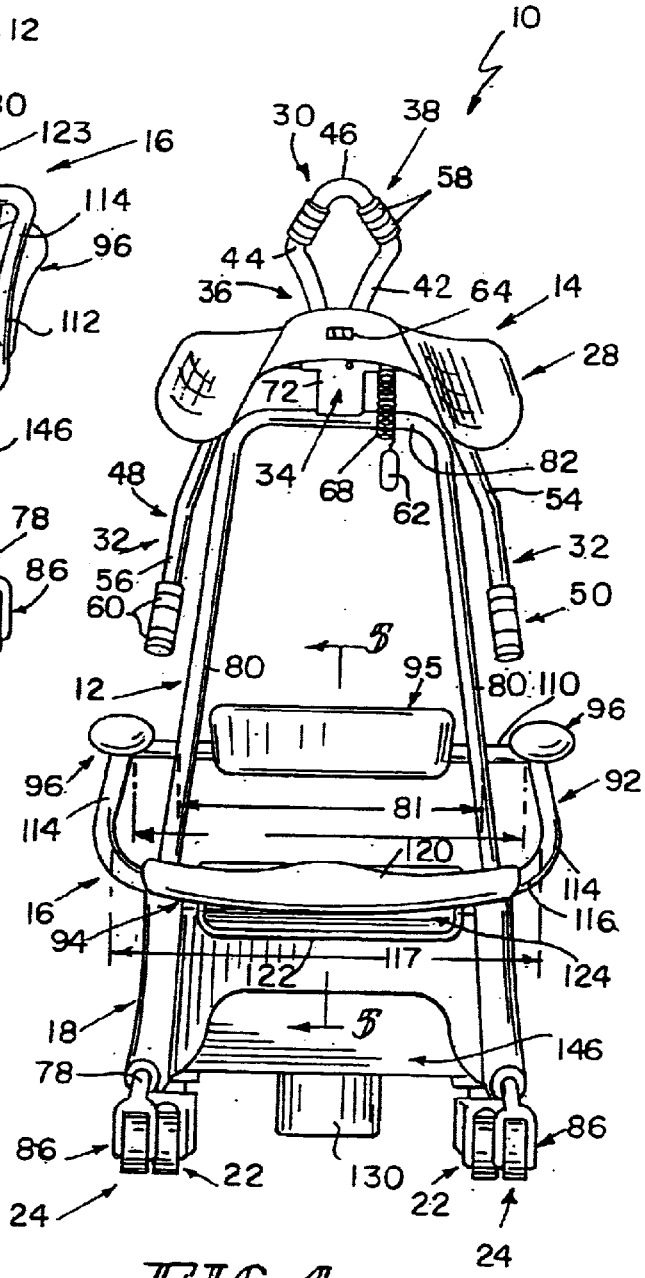
FIG. 4 is a rear elevation view of the walker apparatus showing the seat in a use position.
Figure 5:
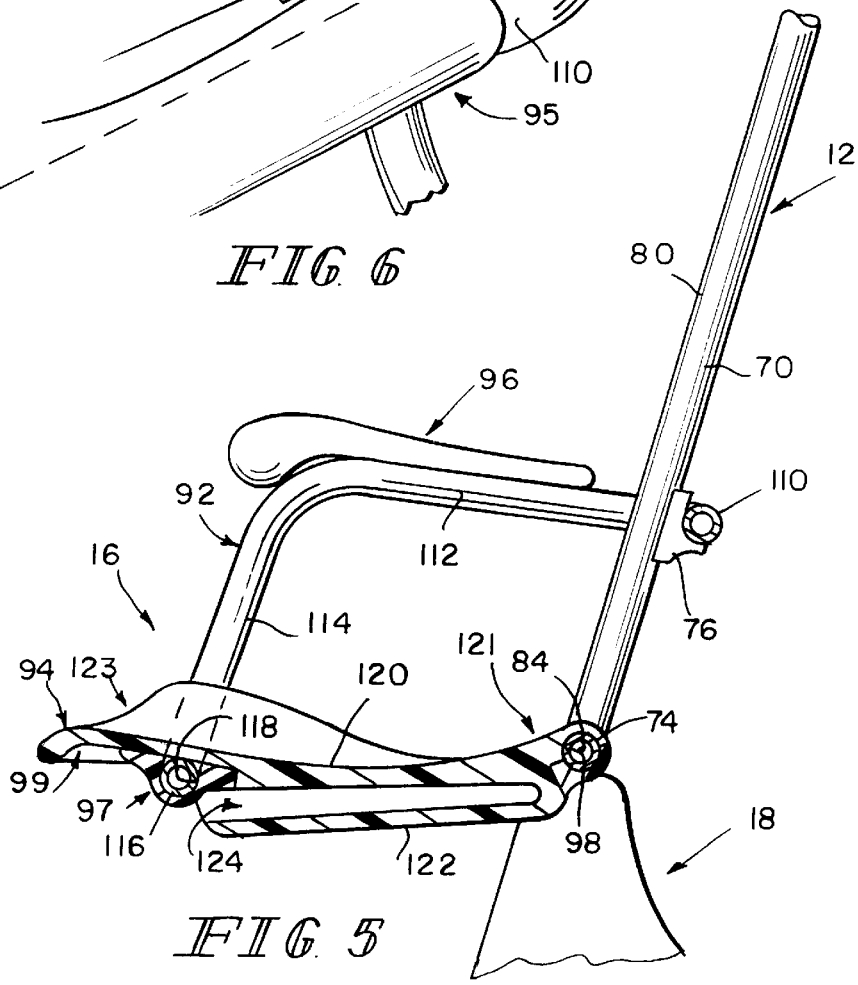
FIG. 5 is a cross-sectional view of the walker apparatus taken along lines 5—5 of FIG. 4 showing the seat including a seat bottom and an arm rest unit including a tubular frame and an arm rest and the frame of the walker apparatus including a clip securing the tubular frame of the arm rest unit to the frame of the walker apparatus.
Figures 7, 8, 9:
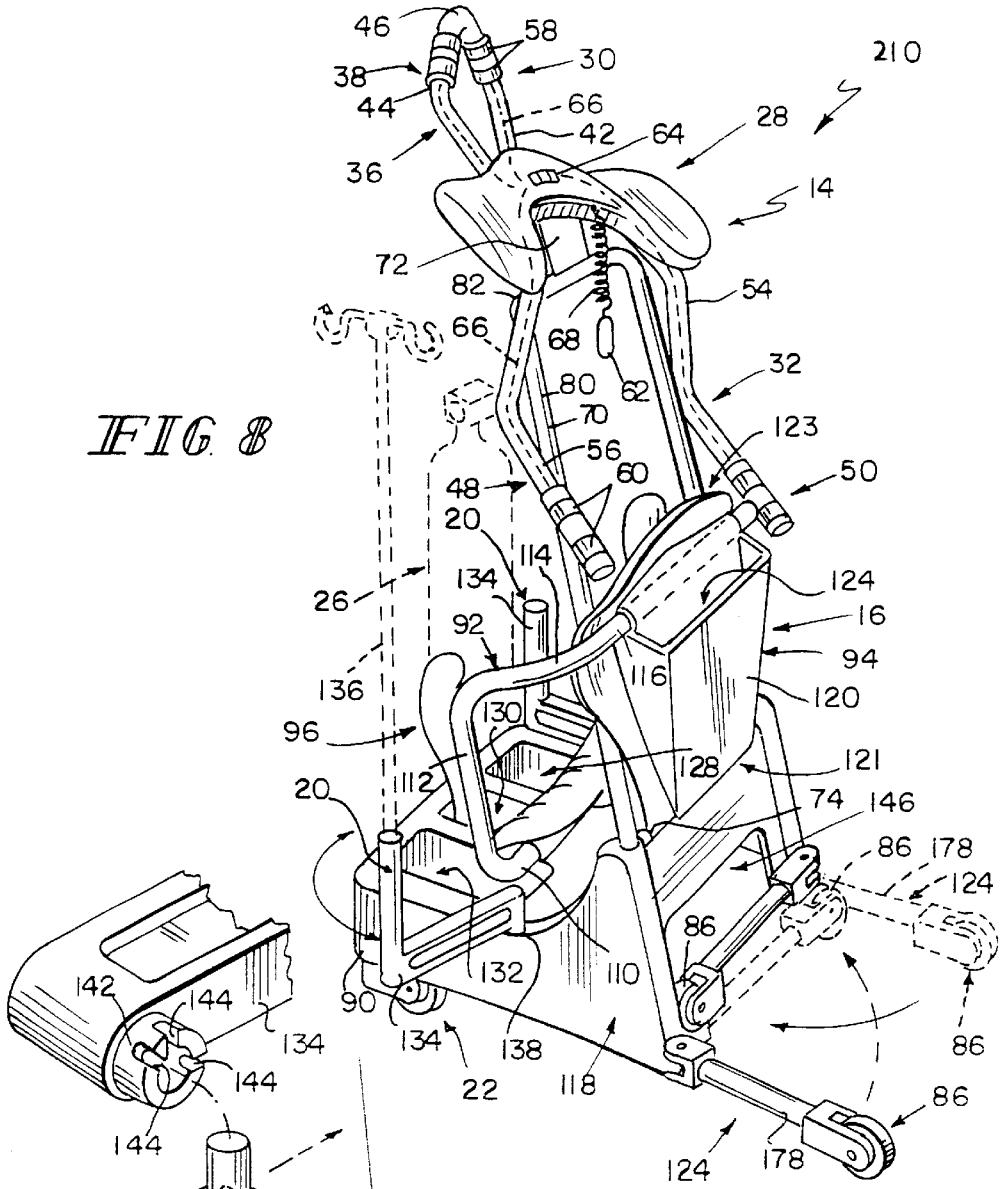
FIG. 7 is a bottom perspective view of a male post of the base module and female post of one of the IV supports showing the male post including a pin and the female post formed to include three pin-receiving detents configured to permit the IV support to pivot between three positions.
FIG. 8 is a perspective view of an alternative embodiment walker apparatus showing the alternative embodiment walker apparatus including a base module and a pair of rear wheel units pivotably coupled to the base module to move between an unfolded use position and a folded storage position.
FIG. 9 is a perspective view of a base module of another alternative embodiment walker apparatus including a pair of rear wheel units slidably coupled to a base module to move between an extended use position (in phantom) and a retracted storage position (in solid).

As shown in FIG. 1, a walker apparatus 10 is provided including a frame 12, an upper body support 14, a seat 16, a base module 18, a pair of IV supports 20, a pair of front casters 22, and a pair of rear wheel units 24. Upper body support 14 is pivotably coupled to frame 12 to move between a use position, as shown in FIG. 2, and a storage position as shown in FIG. 8. Seat 16 is pivotably coupled to frame 12 to move between a storage position, as shown in FIG. 2, and a use position as shown in FIGS. 4 and 5. Base module 18 is coupled to frame 12 and is configured to hold objects such as an oxygen tank 26 (in phantom) as shown in FIG. 8. As shown in FIGS. 1 and 2, IV supports 20 are coupled to base module 18 and are configured to support various medical devices (not shown). Front casters 22 and rear wheel units 24 are coupled to frame 12 to permit a user to push and roll walker apparatus 10 over a floor.

Upper body support 14 includes an arm rest 28, an upper pair of grip handles 30, a lower pair of grip handles 32, and a latch 34. As shown in FIG. 2, a user (in phantom) may rest their forearms on arm rest 28 and grip upper pair of grip handles 30 while in a bent-over position to support the upper body of the user and permit the user to move walker apparatus 10 over a floor. A user may also grip lower pair of grip handles 32 to support the upper body of the user and to permit the user to move walker apparatus 10 over the floor.

Upper pair of grip handles 30 includes a tubular frame member 36 and a pair of grip members 38 coupled to tubular frame member 36. Tubular frame member 36 includes a pair of first segments 40 coupled to arm rest 28, a pair of second segments 42 coupled to respective first segments 40, and a pair of third segments 44 coupled to respective second segments 42 and to one another at a junction 46 therebetween. Each grip member 38 is coupled to a respective second segment 42. According to an alternative embodiment, arm rest 28 includes a pair of pads (not shown) positioned on an upper surface of arm rest 28 to provide a padded area for a user to rest their forearms or elbows.

Lower pair of grip handles 32 includes a pair of tubular frame members 48 coupled to arm rest 28 and a pair of grip members 50 coupled to tubular frame members 48. Each tubular frame member 48 includes a first segment 52 coupled to arm rest 28, a pair of second segments 54 coupled to respective first segments 52, and a pair of third segments 56 coupled to respective second segments 54. Each grip member 50 is coupled to a respective third segment 56.

The configuration of first, second and third segments 40, 42, 44 permit grip members 38 of upper pair of grip handles 30 to be positioned vertically above and in front of arm rest 28 so that when a user leans on arm rest 28 they may grip members 38 in a comfortable manner to support themselves. The configuration of first, second and third segments 52, 54, 56 of tubular frame member 48 permits grip members 50 of lower pair of grip handles 32 to be positioned below and behind arm rest 28 so that a user may stand in an upright position with their arms relatively straight to support themselves.

Walker apparatus 10 is configured to measure and display user vital signs such as a user's heart rate and the oxygen level in the user's blood. Walker apparatus 10 includes a measurement system including four pairs of measurement bands, 58, 60, a pulse oximeter 62, and a digital display 64 coupled to measurement bands 58, 60 and pulse oximeter 62. Measurement bands 58 are coupled to grip member 38 of upper pair of grip handles 30 so that measurement bands 58 contact a user's hands while a user is in the bent-over position as shown in FIG. 2. Measurement bands 60 are coupled to grip members 50 of lower pair of grip handles 32 so that measurement bands 60 are in contact with the user's hands while the user is in an upright position as shown in FIG. 2.

As shown in FIG. 8, measurement bands 58, 60 are coupled to digital display 64 by wires 66 (in phantom). Signals are sent from measurement bands 58, 60 through wires 66 to digital display 64 which then interprets the signals and displays a heart rate so that a user is aware of their current heart rate. If the user recognizes that their heart rate is abnormally high or abnormally low, they may move seat 16 to the use position and rest until their heart rate becomes normal. Furthermore, walker apparatus 10 is provided with an alarm that signals the user that such a condition exists.

Pulse oximeter 62 is coupled to arm rest 28 and electrically coupled to digital display 64 by wires 68. Pulse oximeter 62 can couple to the user's finger, ear lobe, or other part of the user and measures the oxygen level in the user's blood. Pulse oximeter 62 sends a signal along wires 68 to digital display 64 which then interprets the signal and displays the user's blood oxygen level. If the oxygen level in the user's blood is abnormally low or abnormally high, the user may move the seat to the use position and rest until the user's blood oxygen level is within a normal range or until a caregiver is able to assist the user. Furthermore, walker apparatus 10 is provided with an alarm that signals a user that such a condition exists. Examples of pulse oximeters are shown in U.S. Pat. No. 5,891,026 to Wang et al. and U.S. Pat. No. 5,891,021 to Dillon et al. which is hereby expressly incorporated by reference herein.

Other sensors may also be included in walker apparatus 10 that measure other vital signs. For example, sensors that measure a patient's temperature, respiratory functions, blood pressure and other signs may be coupled to digital display 64 so that the user may monitor their physical condition and rest when needed.

Figure 3:
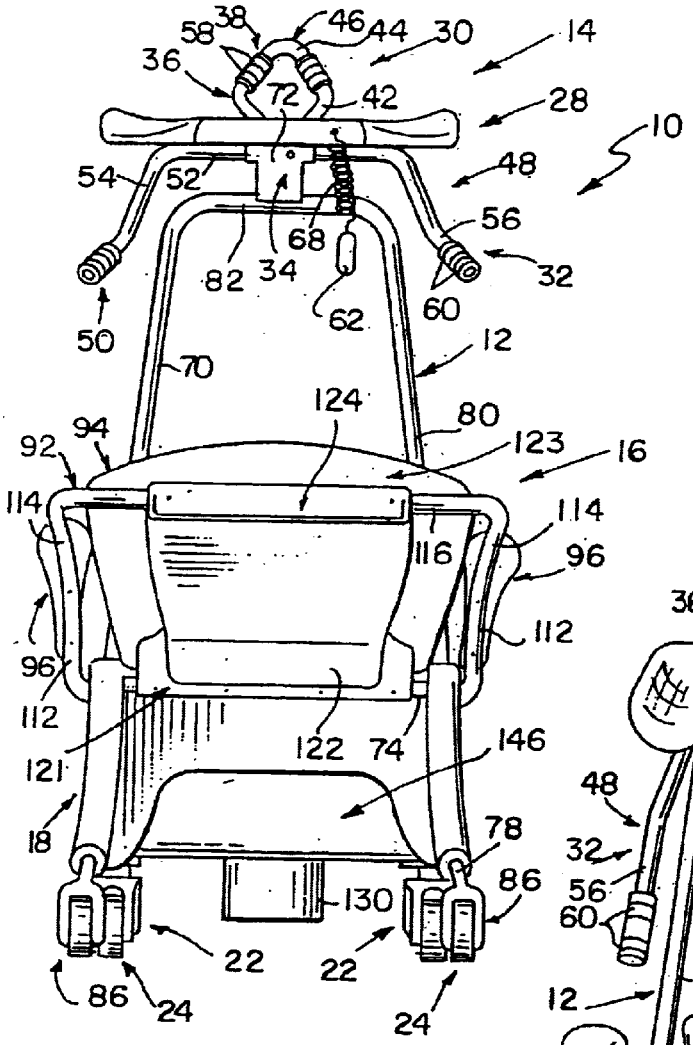
FIG. 3 is a rear elevation view of the walker apparatus showing the seat in the storage position.

As shown in FIGS. 3 and 4, latch 34 is coupled to frame 12 below arm rest 28. Latch 34 permits the user to pivot arm rest 28 between a use position, as shown in FIG. 3, and a storage position as shown in FIG. 4. Latch 34 may be of any type known to one of ordinary skill in the art, preferably latch 34 includes a large button or other latch moving member that permits the user to easily switch upper body support 14 between the use and storage positions. According to an alternative embodiment, latch 34 permits upper body support 14 to move between a multitude of positions such that upper and lower pair of grip handles 30, 32 are adjustable to a multitude of use positions so that a patient may select the most comfortable position for their individual use of walker apparatus 10.

Frame 12 includes a generally U-shaped tubular member 70, a bracket 72 coupled to U-shaped tubular member 70 and upper body support 14, a cross-member 74 coupled to U-shaped tubular member 70, and a pair of clips 76 coupled to U-shaped tubular member 70. U-shaped tubular member 70 includes a horizontal segment 82 coupled to bracket 72, a pair of upright segments 80 coupled to horizontal segment 82 and base module 18, and a pair of leg segments 78 coupled to upright segments 80. Illustratively upright segments 80 extend upwardly, forwardly, and inwardly between rear corners of base module 18 and horizontal segment 82. At an intermediate point, the outer edges of upright segments 80 are spaced apart from each other by a distance 81, as shown, for example, in FIG. 4. According to another alternative embodiment, upright segments 80 of U-shaped tubular member 70 include slidable portions that permit the length of upright segments 80 to be adjusted to position upper body support 14 into a multitude of vertical positions so that walker apparatus 10 can be tailored to a wide variety of user heights.

Bracket 72 couples upper body support 14 to frame 12. Cross-member 74 is coupled to both upright segments 80 and provides a pivot axis 84 for seat 16. Clips 76 are coupled to upright segments 80 and provide a latch to hold seat 16 in the use position. A pair of unidirectional wheels 86 are coupled to outer ends 88 of leg segments 78. In the preferred embodiment, leg segments 78 and wheels 86 comprise rear wheel units 24.

Front casters 22 are coupled to a front end 90 of base module 18. Front casters 22 are follower casters that permit a user to direct walker apparatus 10 in the direction they are pushing. According to the present disclosure, other types of casters or wheels known to those of ordinary skill in the art may also be used for front wheels. According to an alternative embodiment, front casters 22 and wheels 86 may be provided with braking mechanisms to retard or prevent the movement of walker apparatus 10. For example, the casters and wheels of the walker are user weight and/or position sensitive so that when a user sits in the seat, the caster and/or wheels provide braking so that the walker apparatus is unable to roll. Similarly, according to another alternative embodiment, the base or frame of the walker apparatus are configured to engage the floor when the user is in the seated position so that the walker apparatus is unable to roll.

Seat 16 includes a tubular frame member 92, a seat member 94 coupled to tubular frame member 92, a back member 95, and a pair of arm rest members 96 coupled to tubular frame member 92. Tubular frame member 92 includes a back segment 110 coupled to back member 95, a pair of arm segments 112 coupled to back segment 110 and arm rest members 96, a pair of vertical segments 114 coupled to arm segments 112, and a seat segment 116 extending between vertical segments 114 and coupled to seat member 94. Seat segment 116 is rigidly coupled to back segment 110 by arm segments 112 and vertical segments 114. Seat segment 116 and back segment 110 are substantially parallel.

Figure 6:
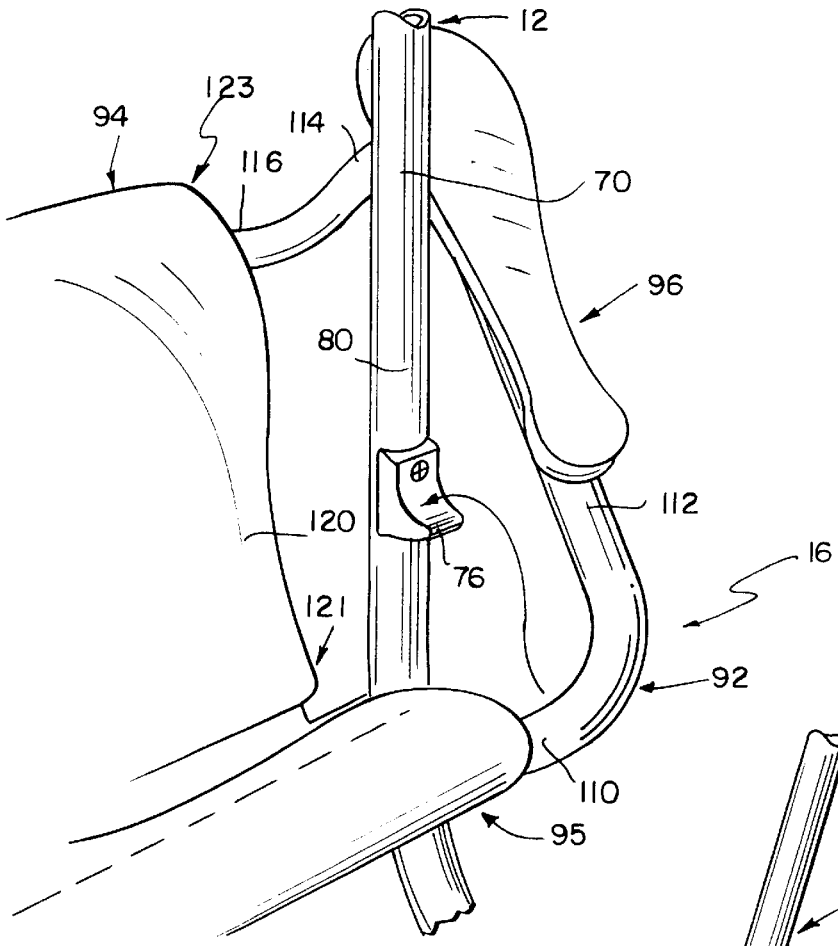
FIG. 6 is a perspective view of the clip of the frame and the tubular frame of the arm rest aligned to be clipped thereto.

As shown, for example, in FIG. 4, seat segment 116 has a length 117 greater than distance 81 between intermediate points on upright segments 80. Likewise, back segment 110 has a length 111 greater than distance 81 between intermediate points on upright segments 80. As shown in FIGS. 5 and 6, back segment 110 engages clips 76 while in the use position so that seat 16 is secured in the use position to frame 12.

As shown in FIG. 5, seat member 94 includes a cross member-receiving channel 98 sized to receive cross-member 74. Cross-member 74 is rigidly coupled to U-shaped tubular member 70 so that when seat 16 is pivoted, seat member 94 pivots but cross-member 74 remains stationary relative to U-shaped tubular member 70. According to an alternative embodiment, cross-member 74 may be journaled onto U-shaped tubular member 70 such that cross-member 74 pivots relative to U-shaped tubular member 72 while seat 16 is moved between the use and storage positions (shown in FIGS. 4, 5 and 1, 2, 8 respectively).

As shown in FIG. 5, seat member 94 includes a seat body 99 and a cover 97 coupled to seat body 99 and formed to include a seat segment-receiving channel 118 sized to receive seat segment 116 as shown in FIG. 5. Seat body 99 includes a top wall 120 contoured to comfortably seat a user, an oppositely facing bottom wall 122 coupled to top wall 120, a rear portion 121, and a front portion 123. Top wall 120 and bottom wall 122 extend between rear portion 121 and front portion 123. Top and bottom walls 120, 122 cooperate to define an article receiving chamber 124. Article receiving chamber 124 is sized to store the user's personal items such as books, magazines, clothing articles, or any such item that a user might find convenient or necessary to transport with them.

As shown in FIGS. 1–4, seat 16 is pivotally mounted to frame 70 of walker 10 for pivotal movement between a use position shown in FIG. 4 and a storage position shown in FIGS. 1 and 2. Crossmember 74 of frame 70 is received in cross member receiving channel 98 in rear portion 121 of seat member 94 allowing seat member to pivot about pivot axis 82. In the illustrated embodiment, seat 16 is coupled only to crossmember 74 of frame 70. Tubular frame member 92 of seat 16 is not directly mounted to frame 70 but is coupled to frame 70 through seat member 94. Illustratively, seat member 94 is rigidly mounted to, and centered on, seat segment 116 of tubular frame 92. Thus as seat 16 pivots about pivot axis 82, the relative orientation of back member 95 and seat member 94 is retained.

Illustratively, seat member 94 is disposed between upright segments 80 of frame 70, and upright segments 80 of frame 70 are disposed between corresponding arm segments 112 and vertical segments 114 on opposite sides of tubular frame 92 of seat 16. This arrangement is possible because the length 117 of seat segment 116 and the length 111 of back segment 110 of seat frame 92 are both greater than the distance 81 between outer surfaces of upright segments 80 of frame 70. Thus as seat 16 pivots between the use position and the storage position arm segments 112 and arm rests 96 attached thereto pass to the outside of upright segments 80 of frame 70.

Since seat frame 92 is rigid and is rigidly mounted to seat member 94, the relative orientation of seat member 94, back member 95 and arm rests 96 is maintained throughout the range of motion of seat 16. In the use position, tops of arm rests 96 and top wall 120 of seat are upwardly facing to support the forearms and buttocks of a user seated on seat 16. In the use position, back member 95 is rearwardly facing to provide support for the lower back of a user seated in seat 16. In use position, back segment 110 of seat frame 92 engages clips 76 of upright segments 80 of frame 70. The rigidity of upright segments 80 and back segment 110 prohibit further rotation of seat 16 in the first direction (i.e., clockwise in FIGS. 1, 2, and 8, counter-clockwise in FIG. 5) when seat 16 is in the use position. Clips 76 act to latch back segment 110 to inhibit rotation of seat 16 in a second direction (i.e., counter-clockwise in FIGS. 1, 2, and 8, clockwise in FIG. 5) when seat 16 is in the use position.

When seat 16 is in the storage position, tops of arm rests 96 and top wall 120 of seat are forwardly facing and bottom wall 122 is rearwardly facing. In the storage position, back member 95 is upwardly facing. In storage position, seat segment 116 of seat frame 92 and upright segments 80 of frame 70 cooperate to inhibit rotation of seat 16 in the second direction (i.e., counter-clockwise in FIGS. 1, 2, and 8, clockwise in FIG. 5). Illustratively, seat segment 116 does not directly engage upright segments 80 when seat 16 is in the storage position, but a portion of seat member is juxtaposed between and engages both seat segment 116 and upright segments 80.

As shown in FIG. 2, back member 95 includes a back segment-receiving channel 126 sized to receive back segment 110. Back member 95 is positioned to provide lower back support for the user while the user is seated in walker apparatus 10.

Base module 18 is formed to include three object-receiving pockets 128, 130, 132. Object-receiving pocket 130 is sized to receive oxygen tank 26 so that a user may conveniently transport an oxygen supply. Object-receiving pockets 128, 132 are sized to receive a liquid oxygen portable device (not shown) or other medical devices or personal belongings that a user may find necessary or convenient to transport while using walker apparatus 10. As shown in FIGS. 3 and 4, base module 18 is formed to include a foot fall opening 146 that provides adequate clearance for the user's feet while the user walks or shuffles and pushes walker apparatus 10.

IV supports 20 include a base 134 and an IV pole 136 (in phantom). IV supports 20 can pivot through a plurality of positions relative to base module 18 as shown in FIGS. 1 and 8. According to the presently preferred embodiment, IV supports 20 may move through three positions. The first position is shown in FIG. 1 where base 134 is at 0° relative to base module 18; a second position is shown in FIG. 8 where base 134 is 90° relative to base module 18; and a third position (not shown) permits base 134 to be pivoted 135° relative to base module 18. IV supports 20 are spaced-apart and permit the user to see clearly in front of them so as not to obstruct the user's line of sight. IV poles 136 are height adjustable between a plurality of positions. In an upper position, IV poles 136 support IV bags (not shown) and in a lower position, IV poles 136 support Foley catheters or drainage bags. According to alternative embodiments, the walker apparatus further includes additional supports coupled to the base or frame configured to support additional IV bags, Foley catheters, or other medical devices.

As shown in FIG. 7, base module 18 includes a male post 138 and a pin 140 coupled to male post 138. Base 134 of IV support 20 includes a female post 142 formed to include three detents 144. Female post 142 is positioned to lie over male post 138 so that pin 140 engages one of the three detents 144 while in one of the previously mentioned positions. As IV support 20 is pivoted, female post 142 is slightly raised relative to male post 138 such that pin 140 moves from detent 144 and base 134 is rotated relative to base module 18 until pin 140 slips into the next respective detent 144, at which position base 134 is held in the next respective position.

As shown in FIG. 8, an alternative embodiment walker apparatus 210 includes a pair of rear wheel units 124 pivotably connected to a base module 118. Rear wheel units 124 include leg segments 178 pivotably coupled to base module 118 and a pair of wheels 86 coupled to leg segments 178. Rear wheel units 124 are permitted to pivot between a use position so that they extend away from base module 118 and a storage position so that they are folder against base module 118. By permitting rear wheel units 124 to pivot in such a manner, walker apparatus 210 will be in a more compact state for storage purposes. Rear wheel units 124 are provided with locking mechanisms (not shown) to lock leg segments 178 into the use position.

According to another alternative embodiment walker apparatus 310, rear wheel units 224 are slidably coupled to a base module 218. As shown in FIG. 9, rear wheel units 224 include leg segments 278 slidably coupled to base module 218 and a pair of wheels 86 coupled to leg segments 278. Rear wheel units 224 are slidably coupled to base module 218 to permit rear wheel units 224 to move between an extended use position (in phantom) and a retracted storage position (in solid). By permitting rear wheel units 224 to slide in and out of base module 218, walker apparatus 310 takes up less space while in the storage position. Rear wheel units 224 are provided with locking mechanisms (not shown) to lock leg segments 278 into the use position.

According to another alternative embodiment walker apparatus, a walker apparatus is provided with a latch or other attachment mechanism that couples to a hospital or other bed. While attached to the bed, the walker apparatus provides steady support to the user attempting to exit the bed. The walker is coupled to the side of the bed to aid a user exiting from the side of the bed or at the foot end of the bed for a user attempting to exit an articulating bed configured in a chair-like position. According to another alternative embodiment, a walker apparatus is provided with a latch or other attachment mechanism that couples the walker apparatus to the bed for transportation therewith. Preferably, the walker apparatus is coupled to the head end of the bed for transportation therewith.

Accordingly, walker apparatus 10 includes a seat for seating, a walker for moving about, and a storage and transportation device for moving medical equipment such as oxygen tanks, IV bags, catheters/drainage bags, IV poles, and personal belongings.

Although the invention has been described in detail with reference to certain preferred embodiments, additional variations and modifications exist within the scope and spirit of the invention as described and defined in the following claims.

What is claimed:

1. A walker apparatus comprising a frame configured to support a user above a floor thereunder, and an upper body support including a forearm rest configured to support the forearms of the user and wherein the forearm rest is pivotably coupled to the frame to move between a generally horizontal use position and a generally vertical storage position.

2. The walker apparatus of claim 1 wherein the frame includes a lower portion, an upper portion and an intermediate portion between the lower and upper portions, the lower and upper portions configured to be disposed in front of a person utilizing the walker for walking movement, the lower and upper portions having side portions, the upper body support including the forearm rest is carried on the frame upper portion to be in front of the person's upper body to provide a support for the upper body when needed, and further comprising wheels movably supporting the frame lower portion.

3. The walker apparatus of claim 2 in which the forearm rest extends upwardly and forwardly from the frame upper portion to support the person's forearms.

4. The walker apparatus of claim 2 in which the forearm rest extends inwardly, upwardly and forwardly from each side portion of the frame upper portion to provide a support for each forearm.

5. The walker apparatus of claim 4 including a handgrip portion disposed forwardly of the forearm rest positioned in front of the person's upper body such that the person can lean forwardly for support.

6. The walker of claim 4 which the upper body support is coupled to the frame for movement between its upwardly and forwardly extending use position and a storage position.

7. The walker apparatus of claim 5 including a handle bar extending rearwardly from each side portion of the frame upper portion to be gripped by the person when walking.

8. The walker apparatus of claim 7 including a wheel support extending rearwardly from each side portion of the lower frame portion, each wheel support having a proximate end mounted to the frame lower portion and a distal end mounted to one of the wheels.

9. The walker apparatus of claim 8 in which the distal end of each wheel support is disposed rearwardly of the handle bar.

10. The walker apparatus of claim 2 including a seat having a patient support surface and a spaced apart oppositely facing lower surface, the seat being attached to the frame for movement between a first position in which the patient supporting surface is upwardly facing to facilitate receipt of a person thereon and a second position in which the lower surface faces a person utilizing the walker for walking movement.

11. The walker apparatus of claim 1 including a patient measurement device coupled to the frame and configured to measure a vital sign of the user.

12. The walker apparatus of claim 11 further comprising a display coupled to the frame and the patient measurement device to receive a signal generated by the patient measurement device and to display a vital sign corresponding to the signal generated by the patient measurement device.

13. The walker apparatus of claim 11 wherein the patient measurement device is a heart rate monitor.

14. The walker apparatus of claim 11 wherein the patient measurement device is a pulse oximeter.

15. The walker apparatus of claim 1 including a first pair of grip handles coupled to the frame and disposed forwardly of the forearm rest, and including a second pair of grip handles coupled to the frame, spaced apart from the first pair of grip handles and disposed rearwardly of the forearm rest.

16. The walker apparatus of claim 15 in which the forearm rest provides an upwardly, forwardly and inwardly extending support for each forearm.

17. The walker apparatus of claim 1 including a first pair of grip handles coupled to the forearm rest to be positioned above and in front of the forearm rest, and including a second pair of grip handles coupled to the forearm rest to be positioned below and behind the forearm rest.

18. The walker apparatus of claim 15, wherein the first and second pairs of grip handles are coupled to the forearm rest.

19. A walker apparatus comprising a frame including a laterally-extending portion configured to be disposed in front of a person utilizing the walker, and an upper body support including a forearm rest pivotably coupled to the laterally-extending portion configured to be disposed in front of the person utilizing the walker to move between a generally horizontal use position and a generally vertical storage position.

* * * * *